US008168910B2

(12) United States Patent
Schlaug et al.

(10) Patent No.: US 8,168,910 B2
(45) Date of Patent: May 1, 2012

(54) CONTACT FOR A MEDIUM-VOLTAGE VACUUM CIRCUIT-BREAKER WITH REINFORCED STRUCTURE, AND AN ASSOCIATED CIRCUIT-BREAKER OR VACUUM CIRCUIT-BREAKER, SUCH AS AN AC GENERATOR DISCONNECTOR CIRCUIT-BREAKER

(75) Inventors: Martin Schlaug, Ed Den Haag (NL); Uwe Ernst, Gauting (DE); Saïd Kantas, Le Cres (FR); Xavier Godechot, Castries (FR); Laëtita Dalmazio, St Gely du Fesc (FR); Pierre Newinger, Le Cres (FR)

(73) Assignee: Areva T&D SAS, Paris la Defense Cedex (FR)

( * ) Notice: Subject to any disclaimer, the term of this patent is extended or adjusted under 35 U.S.C. 154(b) by 73 days.

(21) Appl. No.: 12/792,626

(22) Filed: Jun. 2, 2010

(65) Prior Publication Data

US 2011/0000887 A1 Jan. 6, 2011

(30) Foreign Application Priority Data

Jun. 10, 2009 (FR) ..... 09 53853

(51) Int. Cl.
*H01H 33/66* (2006.01)

(52) U.S. Cl. ..... 218/129; 218/28

(58) Field of Classification Search ..... 218/28, 218/123–129

See application file for complete search history.

(56) References Cited

U.S. PATENT DOCUMENTS

| | | | | |
|---|---|---|---|---|
| 4,052,577 | A * | 10/1977 | Votta | 218/29 |
| 4,109,123 | A | 8/1978 | Lipperts | |
| 4,117,288 | A | 9/1978 | Gorman et al. | |
| 4,334,133 | A | 6/1982 | Gebel et al. | |
| 4,390,762 | A | 6/1983 | Watzke | |
| 5,597,993 | A | 1/1997 | Yorita et al. | |
| 5,691,521 | A | 11/1997 | Komuro et al. | |
| 5,691,522 | A * | 11/1997 | Schulman et al. | 218/128 |
| 5,726,406 | A * | 3/1998 | Bolongeat-Mobleu et al. | 218/123 |
| 6,048,216 | A | 4/2000 | Komuro et al. | |
| 6,072,141 | A * | 6/2000 | Slamecka | 218/127 |
| 6,747,233 | B1 | 6/2004 | Glinkowski | |
| 7,642,923 | B2 | 1/2010 | Ploechinger | |

(Continued)

FOREIGN PATENT DOCUMENTS

DE 19503661 7/1996

(Continued)

OTHER PUBLICATIONS

Yanabu S. et al., "Recent Technical Developments of High-Voltage and High-Power Vacuum Circuit Breakers," Toshiba Publication, Proceedings ISDEIV, 1998, pp. 131-137.

(Continued)

*Primary Examiner* — Truc Nguyen

(74) *Attorney, Agent, or Firm* — Nixon Peabody LLP

(57) ABSTRACT

A vacuum circuit-breaker wherein at least in one of the contacts at least one stud is used as a spacer, and is disposed between the mechanical connection portion and the circular plate of the contact body in such a manner as to avoid the collapse thereof during a closing operation of the vacuum circuit-breaker, and in the closed position the contacts can withstand very high compression forces, typically greater than 700 kg-force or 2 t-force.

11 Claims, 2 Drawing Sheets

U.S. PATENT DOCUMENTS

| | | | |
|---|---|---|---|
| 7,721,428 | B2 | 5/2010 | Stoving et al. |
| 2010/0220418 | A1 | 9/2010 | Willieme et al. |
| 2011/0006041 | A1 | 1/2011 | Schlaug et al. |
| 2011/0073566 | A1 | 3/2011 | Kantas et al. |

FOREIGN PATENT DOCUMENTS

| | | |
|---|---|---|
| DE | 10158576 | 6/2003 |
| EP | 0155376 | 9/1985 |
| GB | 1483899 | 8/1977 |
| JP | 01309224 | 12/1989 |
| JP | 04174919 | 6/1992 |
| JP | 06103859 | 4/1994 |
| JP | 2000208009 | 7/2000 |
| JP | 2009032481 | 2/2009 |
| WO | 2007082858 | 7/2007 |
| WO | 2007110251 | 10/2007 |

OTHER PUBLICATIONS

"Physical and Theoretical Aspects of a New Vacuum Arc Control Technology," Toshiba Publication, Proceedings ISDEIV, 1998, pp. 416-422.

French Preliminary Search Report in French Patent Application No. FR 0953855, mailed Feb. 3, 2010.

French Preliminary Search Report in French Patent Application No. FR 0953853, mailed Jan. 14, 2010.

French Preliminary Search Report in French Patent Application No. FR 0953852, mailed Jan. 15, 2010.

Notice of Allowance in U.S. Appl. No. 12/792,610, mailed Dec. 22, 2011.

Office Action in U.S. Appl. No. 12/792,635, mailed Feb. 29, 2012.

* cited by examiner

CONTACT FOR A MEDIUM-VOLTAGE VACUUM CIRCUIT-BREAKER WITH REINFORCED STRUCTURE, AND AN ASSOCIATED CIRCUIT-BREAKER OR VACUUM CIRCUIT-BREAKER, SUCH AS AN AC GENERATOR DISCONNECTOR CIRCUIT-BREAKER

CROSS REFERENCE TO RELATED APPLICATIONS OR PRIORITY CLAIM

This application claims priority of French Patent Application No. 09 53853, filed Jun. 10, 2009.

TECHNICAL FIELD

The invention relates to medium-voltage vacuum circuit-breakers, sometimes called vacuum bottles.

It relates more particularly to reinforcing the structure of their contacts.

The main application is that in which vacuum circuit-breakers are used as switches in a circuit-breaker, such as an alternative current (AC) generator disconnector circuit-breaker at the output of a power station.

PRIOR ART

Vacuum circuit-breakers have been used for very many years in medium-voltage electrical distribution switchgear to break short-circuit currents of the order of a few kiloamps (kA), typically 25 kA, at a few kilovolts (kV), typically 36 kV. In that type of distribution switchgear, vacuum circuit-breakers must also withstand the continuous current, typically of the order of 1250 amps (A), without overheating. The way they are implanted in the distribution network is such that those vacuum circuit-breakers are closed in normal operation of the network and carry the continuous nominal current.

It is known in the art that in order to break such short-circuit currents, it is necessary to design the arc contacts so that intense axial magnetic fluxes (AMF) are generated at their facing ends in order to extinguish the arc upon separation of the contacts.

The higher the short-circuit current, the higher the generated magnetic flux must be, with an optimum distribution between contacts, in order to obtain efficient arc extinction.

Moreover, for several years, the improving performance of vacuum circuit-breakers has enabled them to be used as switches directly at the AC generator outputs of electrical power stations. The voltages to which they are subjected are therefore of the order of 36 kV, with short-circuit currents to be interrupted of a few thousand amps, typically 63 kA, 80 kA up to 160 kA. The continuous currents at the direct output of the AC generators can reach considerable values, from 9.5 kA up to 26 kA.

Also, producing a vacuum circuit-breaker able to withstand such continuous currents and also to interrupt such very high short-circuit currents can require it to have dimensions that are unacceptable from the cost point of view.

Also, the applicant has already proposed in patent applications WO 2007/110251 and WO 2007/082858 a dynamic solution that consists in inserting a switch into the electrical circuit only during short-circuit arc extinction, thus keeping the switch out of the main electrical circuit and thereby preventing the continuous current from passing through it.

Another problem highlighted by the inventors is that for these applications with high current to be broken, the design of vacuum circuit-breakers, including for implementing the above-mentioned dynamic solution, would require contacts of substantial diameter. However, with such diameters, there is a risk of the contact collapsing or in other words subsiding during a contact closing operation or when the contacts are in the closed position. In order to maintain the vacuum circuit-breaker in its closed position when a high current passes through it, very high mutual compression forces between contacts, of more than 700 kilograms (kg) force, are involved. In addition, during the closing operation, a peak in compression force of more than 2 metric tonnes (t) force can be seen.

An object of the invention is to propose a design for a further improved vacuum circuit-breaker that allows the contacts to mechanically withstand the compression forces that come into play during a closing operation or when the contacts are in the closed position.

A particular object of the invention is to propose a design for a vacuum circuit-breaker that further enables said vacuum circuit-breaker to be used as a circuit-breaker directly at the AC generator outputs of electrical power stations.

SUMMARY OF THE INVENTION

To this end, the invention relates to an electrical contact for a medium-voltage vacuum circuit-breaker, extending along a longitudinal axis Y and including:

a mechanical connection portion that extends along the longitudinal axis Y;

a contact body that includes:

a first hollow cylinder that includes spiral slots about its axis and opening at least onto its exterior, said first hollow cylinder being centered on the longitudinal axis Y and having one end fastened to the mechanical connection portion, the hollow of the first cylinder being empty of material, and the first cylinder constituting a first winding adapted to generate a magnetic field; and a circular plate that has a diameter equal to the outside diameter of the first hollow cylinder, said plate being also centered on the longitudinal axis Y and fastened to the end of the first hollow cylinder opposite that fastened to the mechanical connection portion.

The invention further provides at least one stud that is distinct from the winding(s) and that is arranged, in the hollow of the first cylinder, as a spacer between the mechanical connection portion and the circular plate of the contact body in such a manner as to avoid the collapse thereof during a closing operation and in the closed position of the vacuum circuit-breaker, the spacers having a high electrical resistance such that when a given current flows in the contact, the amount of current that flows in the studs(s) is negligible relative to the current that flows in the winding(s), the stud(s) being made from a metal tube filled with ceramic material(s).

The inventors have astutely thought of using a metal portion for its high strength in combination with a ceramic portion for its high electrical resistance. The inventors have thus made an effective compromise: regarding the technical problem posed by the invention, the ideal solution consists in making the stud as a spacer made solely from ceramic due to the fact that this type of material conducts little or no current. However, the inventors came to the conclusion that such a spacer made exclusively of ceramic, in spite of its intrinsic high stiffness and resistance to compression, presents the risk of being chipped by an impact, even an impact that is not violent. Chipped ceramic particles lead to a significant deterioration in the dielectric performance of a vacuum circuit-breaker.

Thus, the solution of the invention consists in a combined solution, an outer tube or jacket made of metal and filled with ceramic. Thus, the outer jacket and the filling together provide the mechanical reinforcement in order to avoid collapse, in particular at the center of the contact, and the use of ceramic as a filler allows the electrical resistance of each spacer to be greatly increased.

In an embodiment, the second winding consists of a second hollow electrical cylinder that includes spiral slots around its axis and opening out at least to its exterior, the second hollow cylinder being centered on the longitudinal axis Y, concentric with the first cylinder, and having one end fastened to the mechanical connection portion and the other end fastened to the circular plate, the hollows of the cylinders being empty of material.

In another embodiment, the second winding consists of an additional solid part comprising two cylindrical portions and an annular ring that is not looped and that is centered on the two cylindrical portions, each non-looped end of the ring being fastened by an arm to one of the cylindrical portions. The arrangement of this additional part is such that the two cylindrical portions are centered on the longitudinal axis Y and the annular ring is concentric with the first winding. One cylindrical portion is fastened to the mechanical connection portion and the other cylindrical portion is fastened to the circular contact plate. The hollow of the first winding and the space between the annular ring and the solid cylindrical portions are empty of material.

The outside diameter of the first winding of high electrical resistance and of the circular plate lies in the range 90 mm to 150 mm, which is perfectly suitable for an application in which the short-circuit currents to be broken have a value above 80 kA.

Advantageously, the contact may include three identical studs distributed at 120° from one another around a same circumference in the hollow of the first cylinder. Preferably, for the large contact diameters under consideration, e.g. of the order of 120 mm or more, the inventors chose a value of electrical resistance per stud of the order of 2 milliohms (mΩ) giving a total value of 666 microohms (μΩ) for the three studs electrically mounted in parallel. The total resistance of the contact of the order of 2 μΩ to 3 μΩ is thus negligible in comparison with the value of resistance of the studs: in other words, the current flows only a little bit through the studs. Thus, preferably, when a given current flows in the contact, the amount of current that flows in the stud(s) is not greater than 1% of the total amount of current in the contact.

The invention also provides a medium-voltage vacuum circuit-breaker including at least one electrical contact as described above.

The vacuum circuit-breaker may include a pair of electrical contacts comprising a stationary contact as described above and a movable contact as described above.

The invention also provides a circuit-breaker, such as an AC generator disconnector circuit-breaker, including at least one vacuum circuit-breaker as described above.

Finally, the invention also provides the use of such an AC generator disconnector circuit breaker in which the vacuum circuit-breaker carries only a short-circuit current.

BRIEF DESCRIPTION OF THE DRAWINGS

Other advantages and features of the invention emerge more clearly on reading the detailed description given by way of non-limiting illustration with reference to the following figures, in which.

DETAILED DESCRIPTION OF PARTICULAR EMBODIMENTS

Figure 1:
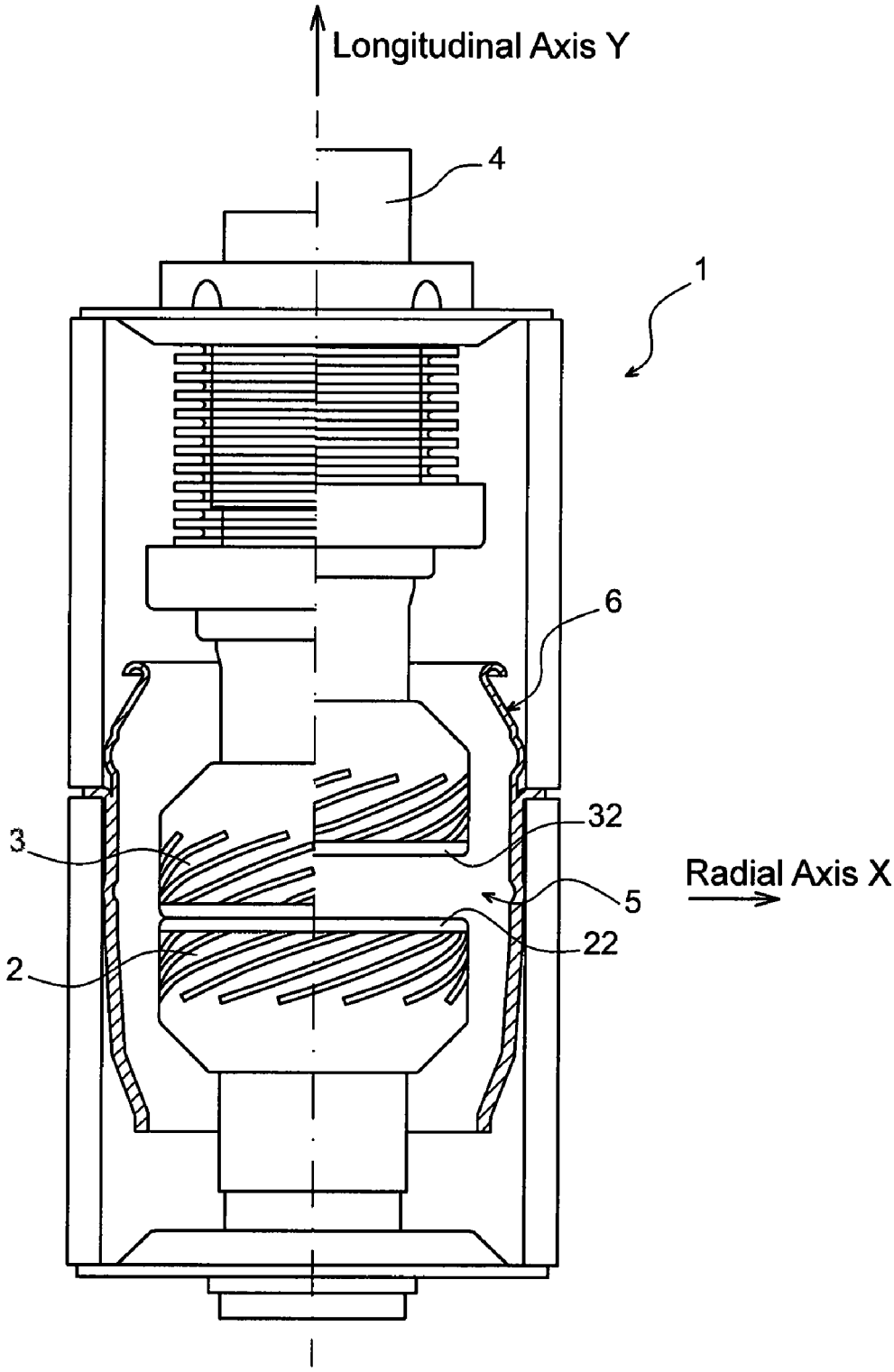
FIG. 1 is a view partly in vertical section of a medium-voltage vacuum circuit-breaker of the invention.

As shown in FIG. 1, a vacuum circuit-breaker 1 of the invention has a longitudinal axis Y and essentially includes a pair of contacts of which one contact 2 is stationary and the other contact 3 is moved by an operating rod 4 between an open position (the portion shown on the right-hand side) and a closed position (the portion shown on the left-hand side).

The contacts 2, 3 in a vacuum circuit-breaker are usually separated to extinguish an arc that is liable to be produced in the space 5 between these contacts Whether in the closed position or the open position, the contacts 2, 3 are inside a shield 6 that is itself inside the jacket 7 of the circuit-breaker, within which there is a vacuum Breaking high alternating currents requires the arc that is generated to be controlled. The arc control means are usually an integral part of the vacuum circuit-breaker. They must therefore ensure that the energy of the arc at the contacts 2, 3 remains below acceptable limits in order to be able to break the current and to withstand the transient recovery voltage. One known type of arc control is axial magnetic field (AMF) arc control. This entails generating a magnetic field parallel to the longitudinal axis Y of the bottle 1.

Figure 2:
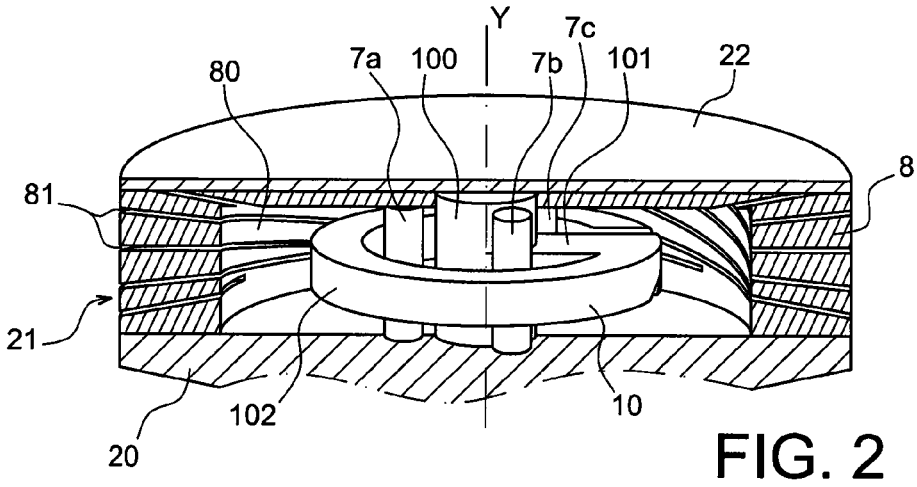
FIG. 2 is a diagrammatic view partially in section of a contact in an advantageous embodiment of the invention.

The AMF arc control means in the contact 2, 3 of the invention thus consist of a component in the form of a cylindrical hollow winding 8 disposed as shown in FIG. 2, i.e. at the periphery of the contact. The hollow 80 of the winding 8 is empty of material. The hollow cylindrical winding 8 includes spiral slots 81 around the longitudinal axis Y and open at least to its exterior.

In order to optimize the AMF arc control means, as claimed in the patent application filed by the Applicant under the number N° FR 09 53852, a second winding 10 is provided that is coaxial with the first winding 8. The second winding is adapted to generate a magnetic field that is superposed on the magnetic field generated by the first winding 8 and that therefore enables the total magnetic field effective in the central portion of the contact to be increased.

As shown in FIG. 2, the second winding consists of an additional solid part 10 comprising two cylindrical portions 100*a*, 100*b* and an annular ring 102 that is not looped and that is centered on the two cylindrical portions 100*a*, 100*b*. Each end 1020, 1021 of the annular ring 102 that is not looped is fastened by an arm 101, 103 to one of the cylindrical portions 100*a*, 100*b*.

Figure 2A:
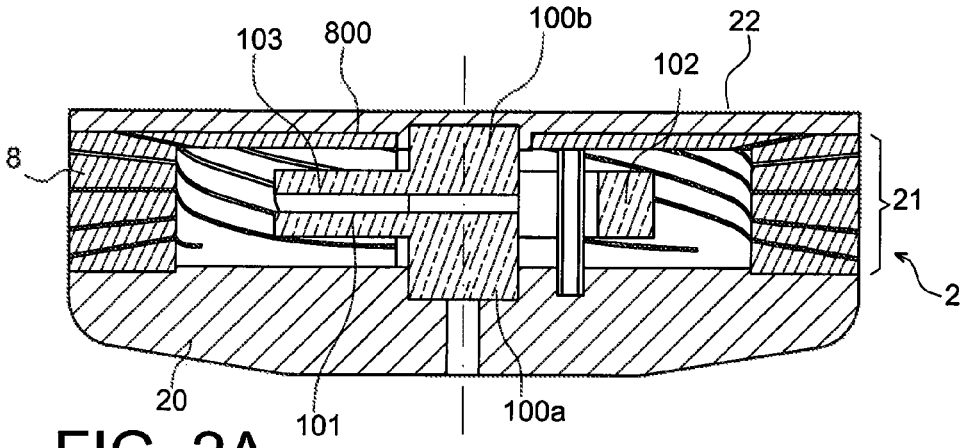
FIG. 2A is a longitudinal section view of a contact of the embodiment shown in FIG. 2.
Figure 3:
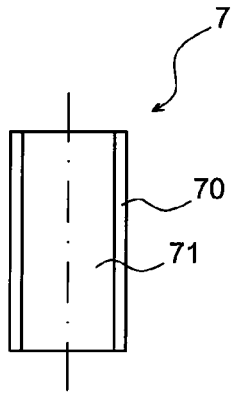
FIG. 3 is a cross section view of a stud implanted in a contact of the invention.

The distance provided between the two ends 1020 and 1021 of the annular ring is a minimum and thus does not influence the value of the magnetic field created by the second winding 10 (FIG. 2A).

The arrangement of this additional part 10 is such that the two solid cylindrical portions 100*a* and 100*b* are centered on the longitudinal axis Y and its annular ring 102 is coaxial with the first cylinder 8. The solid cylindrical portion 100*b* is fastened to the mechanical connection portion 20. The cylindrical portion 100*b* is fastened to the circular plate of contact 22. The hollow 80 of the first cylinder 8 and the space between the annular ring 102 and the cylindrical portions 100*a* and 100*b* are empty of material.

In this embodiment also, the material(s) constituting this additional part 10, its height, its thickness, and the outside diameter of the annular ring 102 are chosen taking into account the dimensions of the contact 2 and of the first winding 8, and as a function of the profile desired for the axial magnetic field AMF.

An annular ring 102 could thus be provided with an outside diameter lying in the range 30% to 80% of the inside diameter of the cylinder of the first winding 8. The exact profile of the axial magnetic field AMF is a function of the outside diameter Dext of the annular ring 102 and of the proportion of current that passes through it relative to the amount that passes through the first winding 8.

A part 10 with a cylinder 102 of small diameter, typically of outside diameter Dext in the order of 30% of the inside diameter of the first winding 8, has the effect of increasing the total magnetic field.

A part 10 with a cylinder 102 of large diameter, typically of outside diameter in the order of 80% of the inside diameter of the first winding 8, has the effect of compensating the weakening of the axial magnetic field in the central portion to a lesser extent, but increases the magnetic field in the intermediate zone between the central portion and the periphery of the contact.

The thickness of the first cylindrical winding 8 is determined by the density of current that passes therethrough and by the total resistance desired for the vacuum circuit-breaker. The total resistance of the vacuum circuit-breaker decreases if the thickness of the windings increases. The thickness of the second winding 10 is limited solely by the available space defined between the mechanical connection portion 20, the first winding 8, and the end contact plate 22. Advantageously, the material(s) constituting the second winding 10 is/are the same as that/those constituting the first winding 8. Naturally, they may be different so long as they have the same electrical properties.

Advantageously, the amount of current that passes through the solid part 10 lies in the range 5% to 30% of the total amount of current I that passes through the contact 2. Thus, dimensions and material may be chosen to constitute the solid part 10 so that said solid part has a current passing through it that is equal to 10% of the total amount of current I passing through the contact 2. For this relative amount of current and with identical elements (portion of mechanical connection 20, contact body 21, first winding 8, circular end plate 22), the axial magnetic field AMF generated by the solid part 10 with an annular ring 102 is greater by 25% to 30% than the axial magnetic field AMF generated by a second winding 9 in the form of a hollow cylinder.

Each prior art contact 2, 3 has a mechanical connection portion 20, 30 and a contact body 21, 31 fastened to the mechanical connection portion. The body 21, 31 includes the winding 8 and an electrode portion 22, 32 in the form of a circular plate. This plate 22 or 32 constitutes the surface of mutual physical contact with the other plate 32 or 22 when the contacts are in the closed position. These contact surfaces 22, 32 are therefore those over which the arc must be diffused as uniformly and as widely as possible.

Each winding 8, 10 is fastened both to the mechanical connection portion 20 or 30 and to the circular plate 22 or 32.

The prior art windings 8 and electrode portions 22, 32 typically have an outside diameter in the range 50 mm to 80 mm to break currents in the range 30 kA to 50 Ka.

For applications in which the current to be broken is greater than 63 kA, for example 80 kA or higher, it is necessary to increase the outside diameters of the contacts and therefore those of the windings. One such application that is specifically targeted is that in which the vacuum circuit-breaker is used as a AC generator circuit-breaker at the output of an electrical power station. The outside diameters can be in the range 90 mm to 150 mm, for example of the order of 120 mm.

However, the inventors have demonstrated that for contacts with these larger diameters in the range 100 mm to 150 mm and made of the same materials and with the same geometry as in the prior art, there exists a risk of collapse, or in other words of the contact 2, 3 subsiding or more exactly the circular plate 22 or 32 subsiding, in particular at the center (about the axis Y).

In the closed position of the vacuum circuit-breaker, the electrical contacts 2, 3 are in mutual compression, against each other. Now, in order to withstand the high values of the above-mentioned electrical currents, the compression forces involved are greater than 700 kg-force. Further, during a closing operation, i.e. while the contacts 2, 3 move towards each other, a peak force value is observed of more than 2 t-force.

Thus, for contacts 2, 3 of large diameter (in the range 90 mm to 150 mm), and produced without specific mechanical reinforcement means, it is possible that the circular plate 22 collapses under such force.

In order to avoid this, the inventors propose implanting one or more stud(s) 7 in the body of the contact 21 to act as (a) spacer(s) between the circular plate 22 and the mechanical connection portion 20. Each implanted stud 7 presents high electrical resistance such that when a given current flows in the contact, the amount of current flowing in the stud 7 is negligible relative to the current flowing in the winding 8 and 10.

Preferably, each stud 7 is constituted by a metal tube 70, typically of stainless steel, filled with ceramic 71. The two elements 70 and 71 of each stud are produced separately using standard production methods. The metal tube 70 is assembled by inserting said tube into a hole provided for this purpose in the base 20. Then, the ceramic insert 71 is inserted in the metal tube 70. Preferably, the fit between the two elements 70, 71 ensures minimum clearance between them. Typically, the metal tube 70 has an inside diameter of 4 mm to 5 mm and an outside diameter of the order of 6 mm. The ceramic insert has a diameter enabling it to be engaged easily.

In the embodiment shown in FIG. 2, three identical studs 7*a*, 7*b*, 7*c* are implanted as spacers in the body of the contact 22. More precisely, these three studs 7*a*, 7*b*, 7*c* are situated on a same circumference at 120° from one another and inside the annular ring 102, i.e. between the cylindrical portions 100*a* and 100*b* and the annular ring 102.

In the embodiment shown, the three studs 7*a*, 7*b* and 7*c* are electrically connected in parallel, so as to present an electrical resistance value of the order of 666 μΩ.

When a current flows in the contact 2, the total electrical resistance of the three studs 7*a*, 7*b*, 7*c* of the invention enables an amount of current to be obtained in the stud(s) that is not greater than 1% of the total amount of current in the contact.

The above-described invention enables the following advantages to be obtained:

avoiding the large-diameter contacts of a vacuum circuit-breaker subsiding when subjected to high compression forces, either during a closing operation, or in the closed position;

having a stud that is produced in the form of a metal tube filled with ceramic and that is simple to manufacture, making it possible to reach the looked-for high compression strength with high electrical resistance and this at a lower cost for manufacturing and implanting in the contact.

The invention claimed is:

1. An electrical contact for a medium-voltage vacuum circuit-breaker, extending along a longitudinal axis Y and including:

a mechanical connection portion that extends along the longitudinal axis Y;

a contact body that includes:

a first hollow cylinder that includes spiral slots about its axis and opening at least onto its exterior, said first hollow cylinder being centered on the longitudinal axis Y and having one end fastened to the mechanical connection portion, the hollow of the first cylinder being empty of material, and the first cylinder constituting a first winding adapted to generate a magnetic field;

a circular plate that has a diameter equal to the outside diameter of the first hollow cylinder, said plate being also centered on the longitudinal axis Y and fastened to the end of the first hollow cylinder opposite that fastened to the mechanical connection portion; and at least one stud that is distinct from the winding(s) and that is arranged, in the hollow of the first cylinder, as a spacer between the mechanical connection portion and the circular plate of the contact body in such a manner as to avoid the collapse thereof during a closing operation and in the closed position of the vacuum circuit-breaker, the studs having high electrical resistance such that when a given current flows in the contact, the amount of current that flows in the stud(s) is negligible relative to the current that flows in the winding(s), wherein the stud(s) is/are made from a metal tube filled with ceramic material(s).

2. An electrical contact according to claim 1, including a second winding arranged in the hollow of the first cylinder and adapted to generate a magnetic field that is superposed on the magnetic field generated by the first winding.

3. An electrical contact according to claim 2, wherein the second winding consists of a second hollow cylinder that includes spiral slots around its axis and opening out at least to its exterior, the second hollow cylinder being centered on the longitudinal axis Y, concentric with the first cylinder, and having one end fastened to the mechanical connection portion and the other end fastened to the circular plate, the hollows of the cylinders being empty of material.

4. An electrical contact according to claim 2, wherein the second winding consists of an additional solid part comprising two cylindrical portions and an annular ring that is not looped and is centered on the two cylindrical portions, each non-looped end of the ring being fastened by an arm to one of the cylindrical portions, the arrangement of this additional part being such that the two cylindrical portions are centered on the longitudinal axis Y and the annular ring is concentric with the first winding, one cylindrical portion being fastened to the mechanical connection portion and the other cylindrical portion being fastened to the circular contact plate, and the hollow of the first winding and the space between the annular ring and the two solid cylindrical portions being empty of material.

5. An electrical contact according to claim 1, wherein the outside diameter of the first winding and of the circular plate lies in the range 90 mm and 150 mm.

6. An electrical contact according to claim 1, including three studs that are identical and distributed at 120° from one another around a same circumference in the hollow of the first cylinder.

7. An electrical contact according to claim 1, wherein when a given current flows in the contact, the amount of the current that flows in the stud(s) is not greater than 1% of the total amount of current in the contact.

8. A medium-voltage vacuum circuit breaker including at least one electrical contact according to claim 1.

9. A vacuum circuit-breaker according to claim 8, including a pair of electrical contacts with a stationary contact and a movable contact.

10. An AC generator disconnector circuit-breaker including at least one vacuum circuit-breaker according to claim 8.

11. Use of an AC generator disconnector circuit-breaker according to claim 10, according to which the vacuum circuit-breaker carries only a short-circuit current.

* * * * *